US005677654A

United States Patent [19]

Särkkä

[11] Patent Number: 5,677,654

[45] Date of Patent: Oct. 14, 1997

[54] DIELECTRIC RESONATOR HAVING PLURAL FREQUENCY-ADJUSTING DISCS

[75] Inventor: Veli-Matti Särkkä, Oulunsalo, Finland

[73] Assignee: Nokia Telecommunications Oy, Espoo, Finland

[21] Appl. No.: 640,800

[22] PCT Filed: Oct. 4, 1995

[86] PCT No.: PCT/FI95/00544

§ 371 Date: Jun. 4, 1996

§ 102(e) Date: Jun. 4, 1996

[87] PCT Pub. No.: WO96/11508

PCT Pub. Date: Apr. 18, 1996

[30] Foreign Application Priority Data

Oct. 5, 1994 [FI] Finland ..... 944660

[51] Int. Cl.[6] ..... H01P 7/10

[52] U.S. Cl. ..... 333/235; 333/219.1

[58] Field of Search ..... 333/219.1, 231, 333/232, 233, 235

[56] References Cited

U.S. PATENT DOCUMENTS 4,849,722 7/1989 Cruchon et al. ..... 333/205

5,315,274 5/1994 Sarkka ..... 333/219.1

5,352,997 10/1994 Särkkä ..... 333/219.1

*Primary Examiner*—Benny Lee

*Assistant Examiner*—Barbara Summons

*Attorney, Agent, or Firm*—Cushman Darby & Cushman Intellectual Property Group of Pillsbury Madison & Sutro LLP

[57] ABSTRACT

A dielectric resonator including a dielectric cylindrical resonator disc, and a resonance frequency controller. The frequency controller includes a dielectric cylindrical adjustment disc provided on the resonator disc so that the adjustment disc is movable in the radial direction for controlling the resonance frequency of the resonator. The frequency controller further includes a dielectric fine adjustment disc, provided on the adjustment disc so that the fine adjustment disc is movable by a movement of an adjustment mechanism with respect to the adjustment disc for fine adjustment of the resonance frequency. Thus, the frequency controller has two slopes of adjustment, whereby the adjustment is fast due to the movement of both adjustment discs, and also extremely accurate due to the fine adjustment function, which is achieved when the thinner adjustment disc alone is moved.

7 Claims, 2 Drawing Sheets

DIELECTRIC RESONATOR HAVING PLURAL FREQUENCY-ADJUSTING DISCS

This application claims benefit of international application PCT/FI95/00544, filed Oct. 4, 1995 published as WO96/11508 Apr. 18, 1996.

BACKGROUND OF THE INVENTION

The invention relates to a dielectric resonator comprising a dielectric cylindrical resonator disc, a frequency controller comprising an adjustment mechanism and a dielectric cylindrical adjustment disc, one of two opposite planar surfaces of the adjustment disc being arranged against one of planar surfaces of the resonator disc so that the adjustment disc is movable by means of the adjustment mechanism in the radial direction with respect to the resonator disc for adjusting the resonance frequency of the resonator, and an electrically conductive casing.

Recently, so-called dielectric resonators have become more and more interesting in high frequency and microwave range resonator structures, as they provide the following advantages over conventional resonator structures: smaller circuit sizes, higher degree of integration, improved performance and lower manufacturing costs. Any object which has a simple geometric shape, and the material of which exhibits low dielectric losses and a high relative dielectric constant may function as a dielectric resonator having a high Q value. For reasons related to manufacturing technique, a dielectric resonator is usually of cylindrical shape, such as a cylindrical disc.

The structure and operation of dielectric resonators are disclosed e.g. in the following articles:

[1] "Ceramic Resonators for Highly Stabile Oscillators", Gundolf Kuchler, Siemens Components XXIV (1989) No. 5, p. 180–183.

[2] "Microwave Dielectric Resonators", S. Jerry Fiedziuszko, Microwave Journal, September 1986, p. 189—189.

[3] "Cylindrical Dielectric Resonators and Their Applications in TEM Line Microwave Circuits", Marian W. Pospieszalski, IEEE Transactions on Microwave Theory and Techniques, VOL. MTT-27, NO. 3, March 1979, p. 233–238.

The resonance frequency of a dielectric resonator is primarily determined by the dimensions of the resonator body. Another factor that has an effect on the resonance frequency is the environment of the resonator. By bringing a metallic or any other conductive surface to the vicinity of the resonator, it is possible to intentionally affect the electric or magnetic field of the resonator, and thus the resonance frequency. In a typical method for controlling the resonance frequency of the resonator, the distance of a conductive metallic surface from the planar surface of the resonator is adjusted. The resonance frequency changes as a non-linear function of the adjusted distance. Due to this non-linearity and the abrupt slope of adjustment, accurate control of the resonance frequency is difficult and demands great precision, particularly at the upper end of the control range. In addition, an unloaded Q value varies as a function of the distance of the conductive plane.

It is possible to maintain the Q value on a constant level, and achieve a more linear frequency control in a wider range by bringing, instead of a conductive tuning plane, another dielectric body to the vicinity of the resonator body. In this case, too, the slope of adjustment is still steep.

One dielectric filter design of this kind is known from Finnish Patent Application 912256. In this prior art resonator, an apparently integral resonator is composed of two dielectric discs set against each other, so that a radial movement of the discs with respect to each other changes the shape of the resonator, whereby changes in the normal field patterns of the electric and magnetic fields cause a change of the resonance frequency. Thus, a relatively linear and a less steep control curve of the resonance frequency is achieved, while maintaining a high and consistent unloaded Q value of the resonator during the adjustment.

In this prior art resonator as well, frequency control is based on a highly accurate mechanic movement, in addition to which the slope of adjustment is still very steep. As the resonance frequency becomes higher, e.g. to the range 1500–2000 MHz or higher, the dimensions of the basic elements of the dielectric filter, such as dielectric discs or adjustment mechanisms are reduced. As a result, adjusting the resonance frequency of a dielectric resonator with this known, though improved solution, sets very high demands on the frequency control mechanism, which, in turn, increases the material and production costs. In addition, as the mechanical movements of the frequency control device must be made very small, control will be slower.

SUMMARY OF THE INVENTION

The object of the invention is a dielectric resonator providing a higher control accuracy and control speed.

This is achieved with a dielectric resonator, which is characterized in accordance with the invention in that the frequency controller further comprises a dielectric fine adjustment disc, one planar surface of which is set against the other one of planar surfaces of the adjustment object, so that the fine adjustment disc is movable by a movement of the adjustment mechanism for fine adjustment of the resonance frequency.

The frequency controller of the resonator of the invention is composed of a pair of joined dielectric adjustment discs, which are arranged in form of a layer structure resting on the resonator disc. The adjustment discs are engaged with each other mechanically so that their radial movement with respect to each other and to the resonator disc provides two adjustment phases during an adjusting movement. At the beginning of the adjusting movement, the smaller, or the thinner disc, i.e. the so-called fine adjustment disc is moved radially a predetermined distance with respect to the larger, or the thicker adjustment disc and the resonator disc, while the adjustment disc remains stationary. Once the smaller adjustment body has moved the above-mentioned distance, the thicker adjustment disc also starts to move in accordance with the adjusting movement in a radial direction with respect to the resonator disc. Thus, a dielectric resonator is provided in which the frequency adjuster has two slopes of adjustment, whereby the adjustment is fast due to the movement of both adjustment discs, and also extremely accurate due to the fine adjustment function, which is achieved when the thinner adjustment disc is moved alone. Due to the invention, the accuracy of adjustment may be increased as high as tenfold, so that the requirements on the accuracy of the adjustment mechanisms do not have to be made stricter when the frequency increases, or the requirements may be even moderated on the presently used frequencies.

BRIEF DESCRIPTION OF THE DRAWING

In the following, the invention will be described in greater detail by way of preferred embodiments with reference to the attached drawings, in which.

DETAILED DESCRIPTION

The structure, the operation and the ceramic manufacturing materials of dielectric resonators are disclosed e.g. in the above-mentioned articles [1], [2], and [3], which are incorporated herein by reference. In the following description, only those parts in the structure of the dielectric resonator which are essential to the invention will be described.

The term dielectric resonator body, as used herein, generally refers to any object which has a suitable geometric shape, and the manufacturing material of which exhibits low dielectric losses and a high relative dielectric constant. For reasons related to manufacturing technique, a dielectric resonator is usually of a cylindrical shape, such as a cylindrical disc. The most commonly used material is ceramic material.

Figure 1:
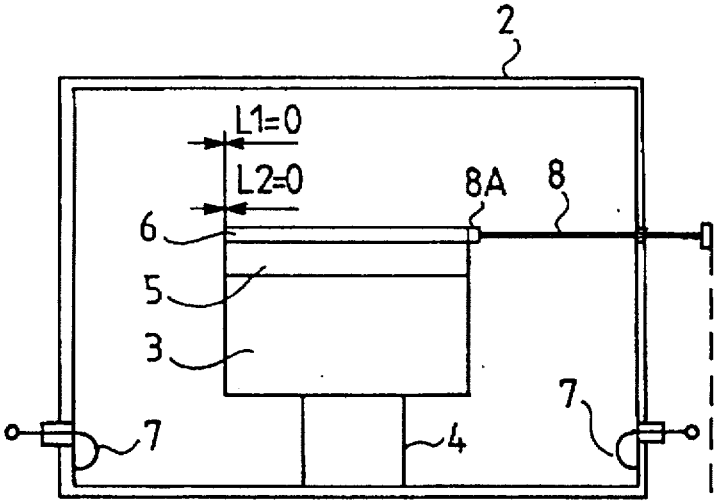
FIGS. 1 and 2 show cross-sectional side views of a dielectric resonator in accordance with the invention in two different adjusting positions.
Figure 2:
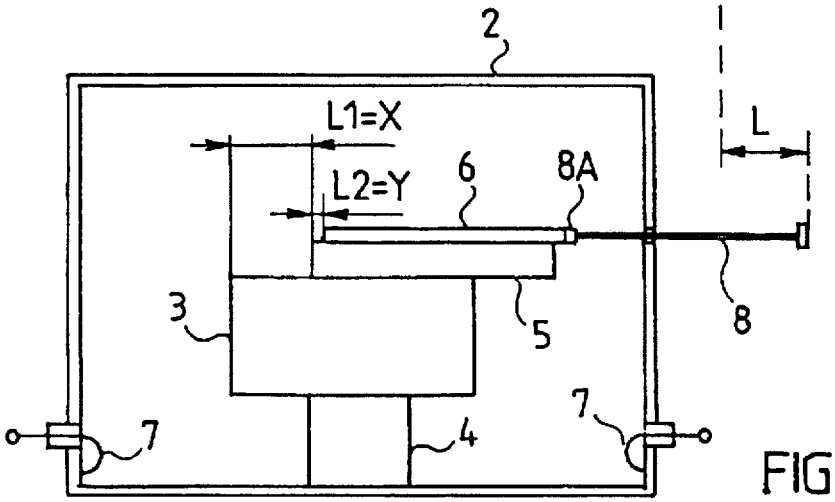
Figure 3:
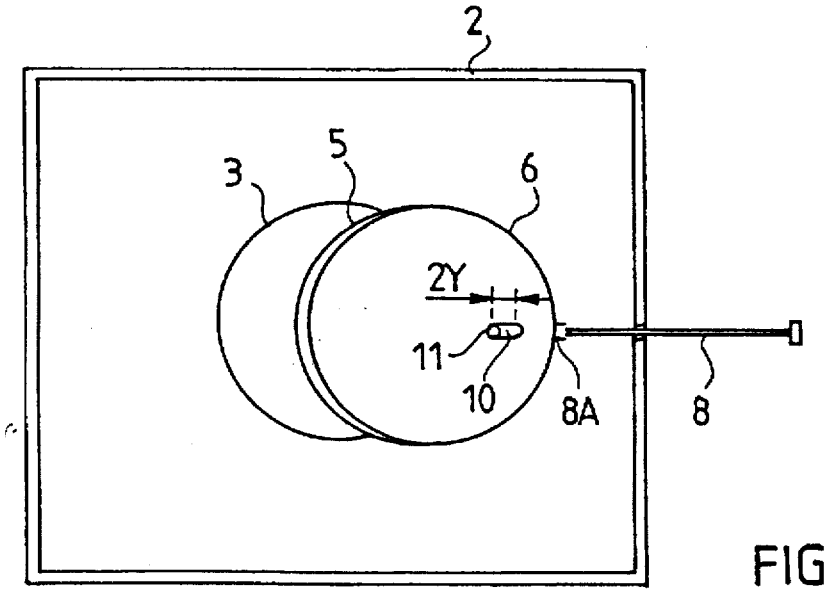
FIG. 3 shows a top view of a dielectric resonator of FIG. 2.

FIGS. 1, 2, and 3 show a dielectric resonator of the invention, comprising inside a casing 2 made of a conductive material, such as metal, a dielectric, preferably cylindrical resonator body 3, preferably of a ceramic material and placed at a fixed distance from the bottom of the casing 2, on a supporting leg 4 made of an appropriate dielectric or isolating material. The casing 2 is connected to the ground potential.

The electromagnetic fields of the dielectric resonator extend beyond the resonator body, so it may easily be coupled electromagnetically to the rest of the resonator circuit in a variety of ways depending on the application, e.g. by means a microstrip in the vicinity of the resonator, a bent coaxial cable, a normal straight line, etc. FIGS. 1 and 2 show, as an example of a coupling to the resonator by inductive switching loops 7, which provide the input and the output of the resonator.

The resonator frequency of a dielectric resonator is primarily determined by the dimensions of the dielectric resonator body 3. Another factor that has an effect on the resonance frequency is the environment of the resonator. By bringing a metallic or any other conductive surface, or alternatively another dielectric body, i.e. a so-called adjustment body, to the vicinity of the resonator, it is possible to intentionally affect the electric or magnetic field of the resonator, and thus the resonance frequency.

The dielectric adjustment element used in the adjustment of the resonator of the invention is composed of a pair of joined cylindrical adjusting discs 5 and 6, which rest in form of a layer structure on the top surface of a resonator disc 3 which is larger or thicker than them, the adjusting disc being supported by an external clamping mechanism, which is not shown in the figure. This clamping mechanism may be, e.g., a spring mechanism of isolation material arranged between the top part of the casing 2 and the adjustment plate 6. More precisely, the larger, or the thicker adjustment disc 5 rests on top of the resonator disc 3 with its bottom planar surface against the top surface of the resonator disc. The smaller, or the thinner fine adjustment disc 6 rests on top of the adjustment disc 5 with the bottom planar surface against the top surface of adjustment disc 5. Adjustment discs 5 and 6 are capable of moving radially with respect to each other and the resonator disc 3 along its top surface by means of an external adjustment mechanism, such as a metallic or ceramic control rod 8. The control rod 8 is connected mechanically with an isolation space 8A solely to an edge of the fine adjustment disc 6. The fine adjustment disc 6, in turn, is engaged mechanically to adjustment disc 5, so that during an adjusting movement, the fine adjustment disc 6 is capable of moving a distance 2Y with respect to the adjustment disc 5, whereafter the adjustment disc 5 will also move in accordance with the adjusting movement of the control rod 8.

In the embodiment shown in FIGS. 1, 2 and 3, in order to obtain the mechanical engagement between discs 5 and 6, the fine adjustment disc 6 is provided with a radial and elongated hole 10, and adjustment disc 5 is provided with a pin-like projection 11 on its top surface, which extends into the hole 10 in the fine adjustment disc 6. The dimensioning of the pin-like projection 11 and the hole 10 is such that the fine adjustment disc is allowed a radial movement of 2Y in distance on top of the adjustment disc 5, before either end of the hole 10 of the fine adjustment disc 6 engages itself to the pin-like projection, and thus transfers the movement of the adjustment rod so that it causes the adjustment disc 5 to move.

The radial movement of adjustment disc 5 and the fine adjustment disc 6 with respect to each other and the resonator disc 3 thus results in two adjustment phases during an adjusting movement. At the beginning of an adjusting movement, the fine adjustment disc 6 will move the distance 2Y with respect to adjustment disc 5 and the resonator disc 3, while adjustment disc 5 is stationary. Once the fine adjustment disc 6 has moved said distance 2Y, adjustment disc 5 also starts to move in accordance with the adjusting movement.

FIG. 1 shows a situation in which both adjustment disc 5 and the fine adjustment disc 6 are concentric with the resonator disc 3, i.e. L1=0 and L2=0. FIGS. 2 and 3 show a situation in which adjustment disc 5 has been moved radially by the distance L1=X with respect to the resonator disc 3, and the fine adjustment disc 6 by the distance L2=Y with respect to the adjustment disc 5, i.e. by the distance L1+L2 with respect to the resonator disc 3, when the movement of the adjustment rod is L=L1+L2.

Figure 4:
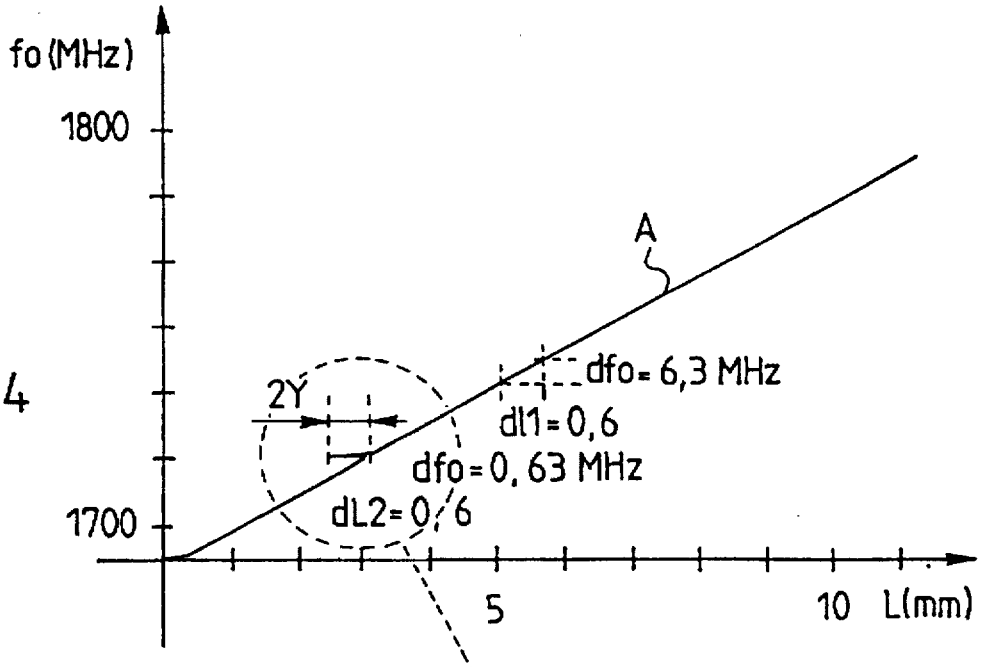
FIG. 4 shows a graph illustrating the resonance frequency of the resonator of FIGS. 1,2 and 3 as a function of distance L.
Figure 4A:
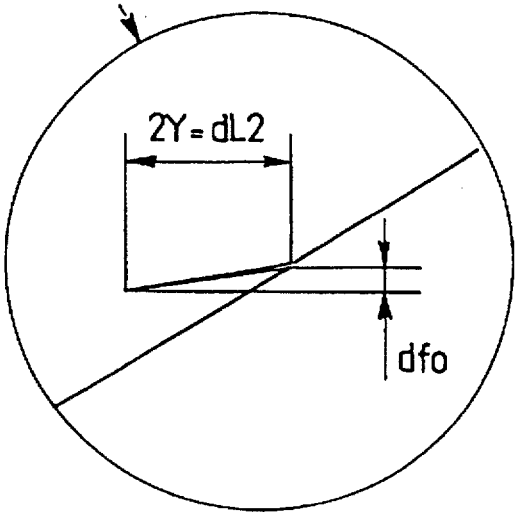
FIG. 4A shows an enlarged detail of the graph of FIG. 4.

In accordance with the invention, a dielectric resonator is provided in which the frequency controller has two slopes of adjustment, whereby the adjustment is fast when both adjustment discs 5 and 6 are moving, and slower when only the fine adjustment disc 6 is moving, yet extremely accurate. The graph shown in FIG. 4 shows the resonance frequency fs of the resonator of the invention as a function of the movement L of the adjustment plane. In FIG. 4, a curve A depicts the adjustment when both adjustment discs 5 and 6 are moving, whereby the adjustment slope is df0/dL1, e.g. 6.3 MHz/0.6 mm. At the circle marked with a dotted line, fine adjustment is performed solely with a movement of the fine adjustment disc 6, which is achieved e.g. by changing the direction of movement of the control rod 8. The part of the curve A corresponding to the fine adjustment situation is shown enlarged in FIG. 4*a*, from which appears that the fine adjustment slope df0/dL2 is remarkably lower than df0/dL1, e.g. 0.63 MHz/0.6 mm. The ratio of the adjustment slopes is directly proportional to the ratio of the sizes of adjustment discs 5 and 6. In other words, appropriate adjustment slopes may be chosen by choosing the appropriate size for the adjustment discs.

The figures and the explanation associated therewith are only intended to illustrate the present invention. The resonator of the invention may vary in its details within the scope of the attached claims.

I claim:

1. A dielectric resonator comprising:

a dielectric cylindrical resonator disc, a frequency controller, comprising an adjustment mechanism and a dielectric cylindrical adjustment disc one of two opposite planar surfaces of the adjustment disc being arranged against a planar surface of the resonator disc so that the adjustment disc is movable by means of the adjustment mechanism in the radial direction with respect to the resonator disc for adjusting the resonance frequency of the resonator, and an electrically conductive casing, the frequency controller further comprising a dielectric fine adjustment disc, one planar surface of which is set against the other one of said two planar surfaces of the adjustment disc so that the fine adjustment disc is movable by a movement of the adjustment mechanism with respect to the adjustment disc for fine adjustment of the resonance frequency provided by said dielectric resonator.

2. The resonator as claimed in claim 1, wherein:

said resonator disc is thicker than said adjustment disc and said fine adjustment disc, and said resonator disc is supported in a fixed position.

3. The resonator as claimed in claim 1, wherein:

said adjustment disc is thicker than said fine adjustment disc.

4. The resonator as claimed in claim 1, wherein:

said adjustment disc and said fine adjustment disc are provided with engagement means, which allow, due to the effect of said adjustment mechanism, a predetermined radial movement of said fine adjustment disc along said other one of said planar surfaces of said adjustment disc before causing engagement between said fine adjustment disc and said adjustment disc, said engagement enabling movement of said adjustment mechanism also to move said adjustment disc radially along said planar surface of said resonator disc.

5. The resonator as claimed in claim 4, wherein:

said fine adjustment disc comprises a radial elongated hole having two horizontally opposite ends, and on said other one of said two planar surfaces of said adjustment disc there is provided a projection, pin, which extends into said hole of said fine adjustment disc, said pin and said hole being dimensioned so that a predetermined radial movement of said fine adjustment disc on top of said adjustment disc is allowed before said pin in said hole of said fine adjustment disc engages with a respective one of said ends of said hole of said fine adjustment disc, and transfers movement of said adjustment mechanism also to move said adjustment disc.

6. The resonator as claimed in claim 1, wherein:

said adjustment disc and said fine adjustment disc are sized and shaped such that during common movement of said adjustment disc and said fine adjustment disc, said resonance frequency adjustment has a first slope of adjustment, and that upon said fine adjustment disc moving alone, said resonance frequency adjustment has a second slope of adjustment, which is remarkably lower as compared with said first slope of resonance frequency adjustment.

7. The resonator as claimed in claim 1, wherein:

said adjustment mechanism comprises a control rod connected with said fine adjustment disc.

* * * * *